United States Patent [19]

Wickers et al.

[11] 4,450,781

[45] May 29, 1984

[54] THREAD WIPING MECHANISM

[75] Inventors: Francis A. Wickers; Adolph S. Dorosz, both of Beverly, Mass.

[73] Assignee: USM Corporation, Farmington, Conn.

[21] Appl. No.: 364,495

[22] Filed: Apr. 1, 1982

[51] Int. Cl.[3] ..... D05B 65/06; D05B 49/00

[52] U.S. Cl. ..... 112/262.1; 112/286

[58] Field of Search ..... 112/262.1, 262.3, 286, 112/302, 221, 253, 225

[56] References Cited

U.S. PATENT DOCUMENTS

| | | | |
|---|---|---|---|
| 1,999,145 | 4/1935 | Vollman | 112/286 X |
| 2,902,960 | 9/1959 | Ketterer | 112/286 |
| 3,160,125 | 12/1964 | Bryant et al. | 112/221 X |
| 3,498,243 | 3/1970 | Aoyama | 112/286 |
| 3,547,058 | 12/1970 | Brown et al. | 112/221 X |
| 3,847,102 | 11/1974 | Rogner | 112/286 |
| 3,960,098 | 6/1976 | Papajewski et al. | 112/286 |

FOREIGN PATENT DOCUMENTS

| | | | |
|---|---|---|---|
| 52-21930 | 1/1977 | Japan | 112/286 |

*Primary Examiner*—H. Hampton Hunter

*Attorney, Agent, or Firm*—Donald N. Halgren

[57] ABSTRACT

A multiple needle sewing machine having a shiftable needle mechanism wherein threaded needles may be shuttled from an active to an inactive position and vice versa. A thread wiping mechanism, comprising an arrangement of articulated fingers is disposed adjacent the needles' inactive positions. Upon a proper signal, the fingers extend to a position to await the inactive needle, whereupon, the fingers will be retracted, catching only the thread of the inactive needle holding it out of the way of the needle in the active position. The thread wiping mechanism may be actuated by reciprocable means attached to the fingers, which actuation occurs upon receipt of a proper signal during operation of the sewing machine.

14 Claims, 4 Drawing Figures

THREAD WIPING MECHANISM

BACKGROUND OF THE INVENTION (1) Field of the Invention

This invention relates to sewing machines, and more particularly to sewing machines having multiple threads and needles.

(2) Prior Art

Multiple threads and multiple needles on sewing machines are useful mechanisms for improving product output. The mechanisms are typically used for tufting or embroidering and may be seen as embodiments in U.S. Pat. Nos. 3,724,405 to Mullen, Jr.; 3,547,058 to Brown et al; and 3,160,125 to Bryant et al. They each show multiple needle arrangements with transfer mechanisms therefor. The '405 patent discloses an embroidery machine permitting threads of different colors to be stitched into a material, using a complicated solenoid arrangement for empowerment thereof. The '058 patent also discloses a solenoid driving arrangement, which therein utilizes a scanner to traverse a pattern being reproduced. The '125 patent discloses a tufting machine with a bank of needles controlled by a long thrust bar and thrust rods. These machines are often inflexible as to providing a variety of stitch work, because they utilize long arrays of linkages and drives that cannot be readily adapted to doing tight tensioned work through heavy pieces of material, that is, sewing which is mostly functional or non-decorative.

A recent improvement in multi-needle sewing machines is shown in U.S. patent application Ser. No. 315,415, filed on Oct. 15, 1981 which discloses a shuttleable needle mechanism that allows multiple threads to be sewn into material. When one color or particular thread is desired, the needle carrying that particular thread is shifted to the active position activated, and the needle carrying the then unwanted thread is shifted to and held in an inactive position. The needles are simultaneously movable, upon actuation of the proper circuitry, to their respective active/inactive positions. When the needles shift from one position to another, however, their thread tails may become tangled with one another. A vacuum apparatus is described in the above-identified application, arranged adjacent the needles to suck the tails of the inactive needle's thread out of the way of the active needle's thread, as well as to prevent its being sewn in with the thread of the newly active needle.

Thus, it is an object of the present invention to provide a sewing machine mechanism capable of overcoming some of the disadvantages of the prior art.

It is a further object of the present invention to provide a sewing machine capable of utilizing several needles with their own respective threads, the threads being varied in color, size or texture from one another, with neither thread getting in the way of the one, hindering the sewing operation.

BRIEF SUMMARY OF THE INVENTION

The present invention comprises an apparatus for wiping threads of inactive needles out of the work area of active needles in multiple needle sewing machines. The sewing machine comprises a pair of needles, each movable longitudinally when situated in a working or active position, and each being movable transversely to an inactive position to permit the other needle to assume the active, working position. Each needle is threaded and held in a support or needle holder. Each needle holder is arranged in a needle holder indexer which permits longitudinal movement of the needle holders therein. The needle holder indexer or carriage, shuttles the holders from the active position to one or the other of the inactive positions. The needle holder indexer is linked to an indexing cylinder which, when properly actuated, effectuates the transverse shuttling movement of the needles in their supports in a needle holder cage. A pair of fixed axis wheels or biasing devices such as clips or the like may be disposed beneath the needle holder cage, one for each wheel, between the active, middle work station, and the respective inactive stations on both sides of the active station. Transverse movement of either needle and its needle holder from the active position to its respective inactive position is sufficient to clinch the thread of the needle between its respective wheel and the lower portion of the needle holder to prevent the thread from being inadvertently pulled out of the needle.

Adjacent each inactive station is a thread wiping mechanism, directed towards the tip of the needle. The thread wiping mechanism comprises a pair of articulated fingers which are movable into and away from the area of the tip of the inactive needle by drive means, actuated prior to the needles shifting from one position to the other.

The drive means comprises at least one pressurizable double acting cylinder which is fixedly attached to the sewing machine head adjacent the needle area, on the side thereof opposite from where an operator would be operating the sewing machine.

The articulated fingers are each disposed on the distal end of a shaft, which shaft is secured to a bracket on the distal end of a piston rod which extends from the pressurizable cylinder. The bracket guides each shaft during their longitudinally directed movements.

The articulated fingers may preferably be hook shaped or they may have a tang extending out of the plane of the hook, towards its respective needle.

In operation of the thread wiping mechanism, prior to the shifting of the needles to their respective active and inactive positions, both articulated fingers may be advanced on their shafts, to a point beyond the tips of their needles. The needles are then shifted, one to the active position and the other, to its inactive or standby position. The thread from the to-be-active needle is released from its clinched position between the fixed axis biasing wheel and the needle holder. The thread from the needle moving into the standby or inactive position is caused to pass between its respective fixed axis biasing wheel and its respective needle holder, thereby holding it tightly. When the pressurizable cylinder retracts the shafts and their respective articulated fingers, only the thread from the standby needle is hooked and its tail end is pulled from the workpiece and is clamped against an abutment panel which is disposed parallel to the articulated fingers. This motion does not pull the thread from the needle, because it is clinched at a point therebetween. The thread from the needle in the active position is out of the way of the other articulated finger, which articulated finger is limited to movement towards and away from the position of the inactive needle. Thus, while both fingers may be moved simultaneously, only the finger adjacent the inactive needle, will pick-up the thread therefrom, holding it against a wiping plate which is arranged parallel to each finger at its retracted position.

BRIEF DESCRIPTION OF THE DRAWINGS

The objects and advantages of the present invention will become more apparent when viewed in conjunction with the following drawings in which.

DESCRIPTION OF THE PREFERRED EMBODIMENT

Figure 1:
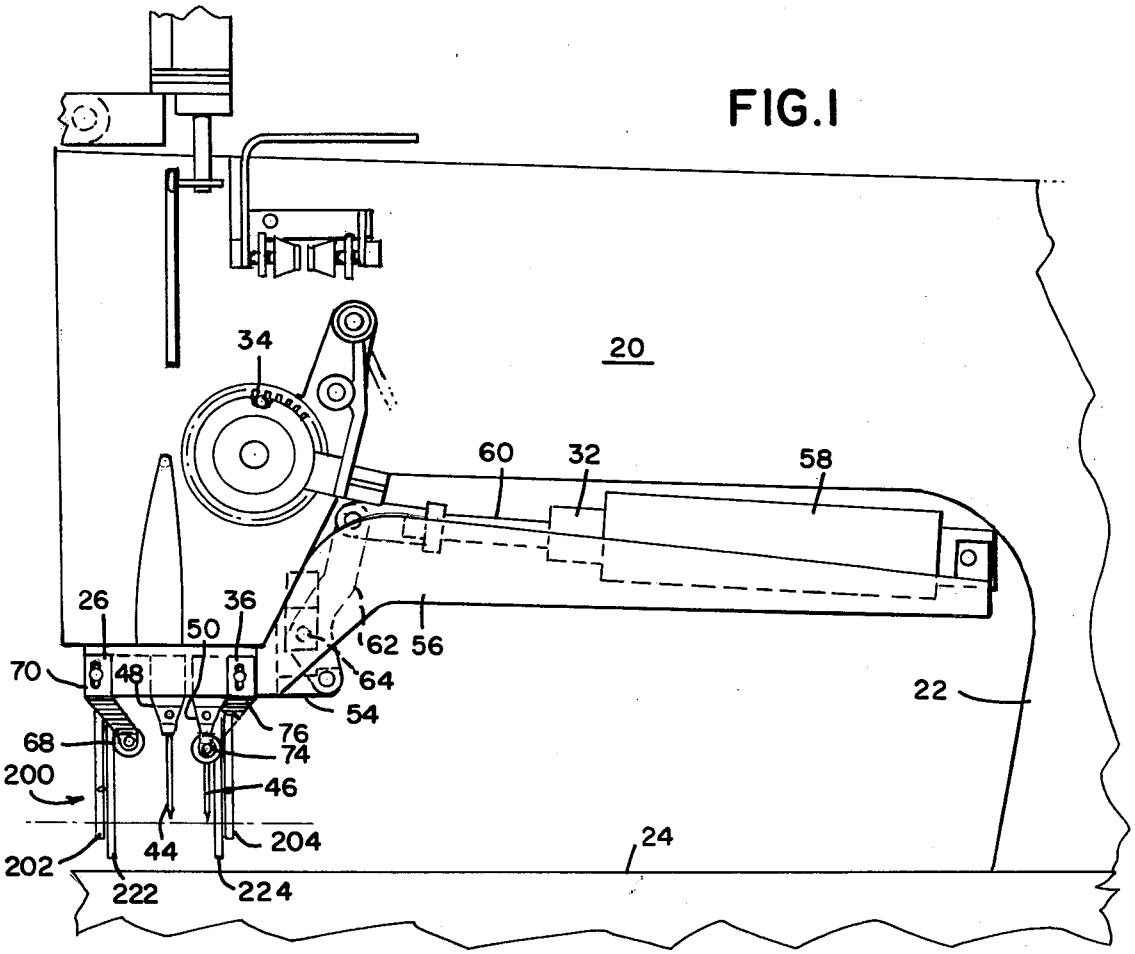
FIG. 1 is a side elevational view of a sewing machine constructed according to the principles of the present invention.

Referring now to the drawings in detail and particularly to FIG. 1, there is shown an automatic thread changing sewing machine 20 capable of alternately sewing two different threads into an item to be stitched, generally similar to the sewing machine shown in U.S. patent application Ser. No. 315,415, filed Oct. 15, 1981, now incorporated herein by reference. The threads in each needle may be of a different color, texture, or size, depending upon the requirements of the item being sewn. The sewing machine 20 comprises a housing 22 disposed on a work support table 24. A stitching mechanism 26 is disposed at one end of the housing 22 and is connectively associated therethrough by a drive shaft to a drive means, not shown, arranged at the other end of the housing 22. An indexing mechanism 32 is connected to the stitching mechanism 26 to effectuate shuttling therein. A bobbin monitor 34 controls the thread feed and usage, and checks for irregularities associated therewith.

The stitching mechanism 26 comprises a needle holding cage 36 which mounts against the lower side of the housing 22. A first needle 44, and a second needle 46 are each secured in a needle holder, 48 and 50 respectively. An extension 54 slides under a bracket 56 one end of which bracket 56 is secured to the needle holding cage 36. The other end of the bracket 56 pivotally supports an indexing cylinder 58, which comprises a part of the indexing mechanism 32. The indexing cylinder 58 has a piston, not shown, and a piston rod 60 which is pivotally connected to one end of an indexing lever 62. The other end of the indexing lever 62 is swingably connected to the extension 54 of the needle holder indexer 42 shown in the above referenced patent application. An elbow 64 disposed near the midpoint of the indexing lever 62, is pivotally attached to the bracket 56.

A first thread nipper comprising a biasing element or resilient wheel 68 on a first bracket 70 is secured to the needle holder cage 36, and a second thread nipper comprising a biasing element or resilient wheel, 74, on a second bracket 76, is also secured to the needle holder cage 36. The first thread nipper is disposed close to the position of the first needle 44 in its inactive position, and the second thread nipper is disposed close to the position of the second needle 46 when it is in its inactive position.

Figure 2:
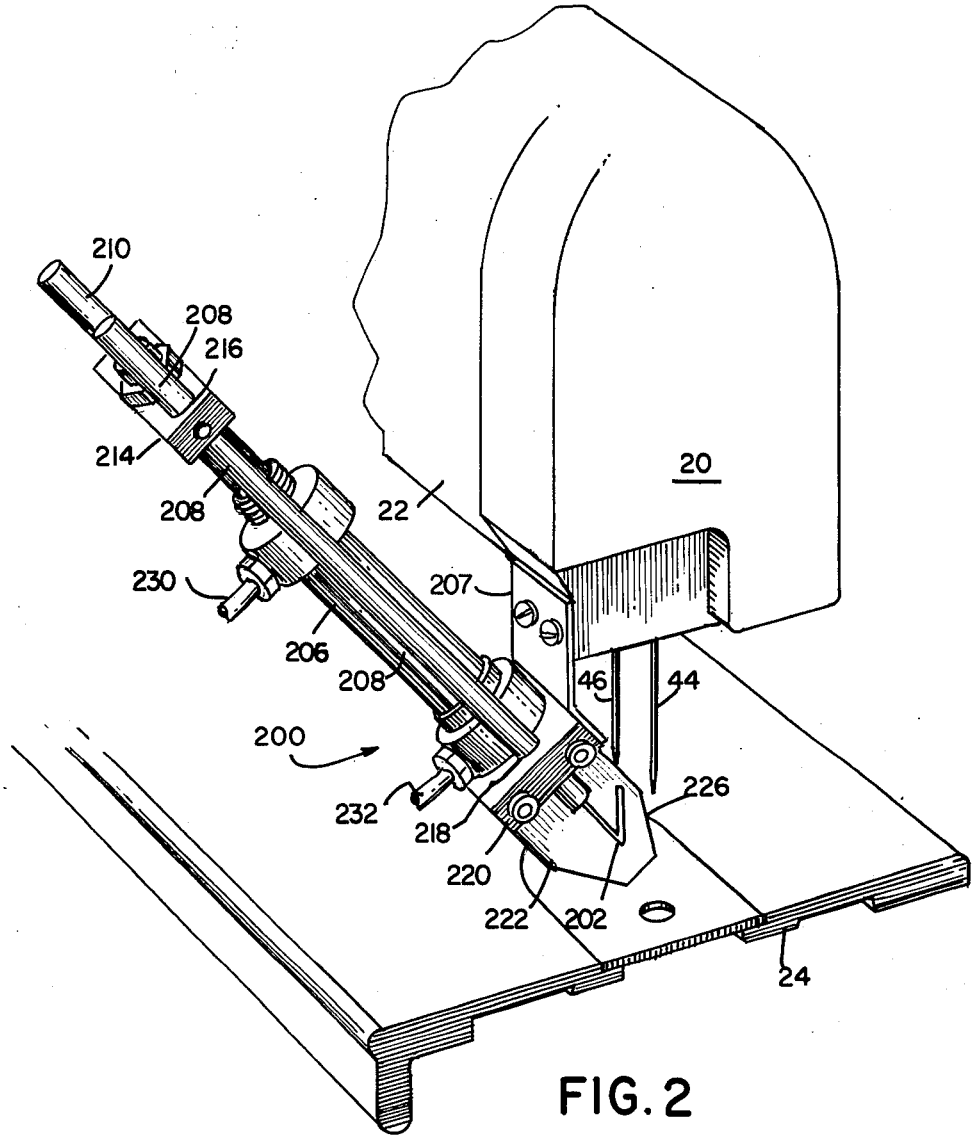
FIG. 2 is a partial perspective view of the thread wiping mechanism towards the head end of the sewing machine.
Figure 3:
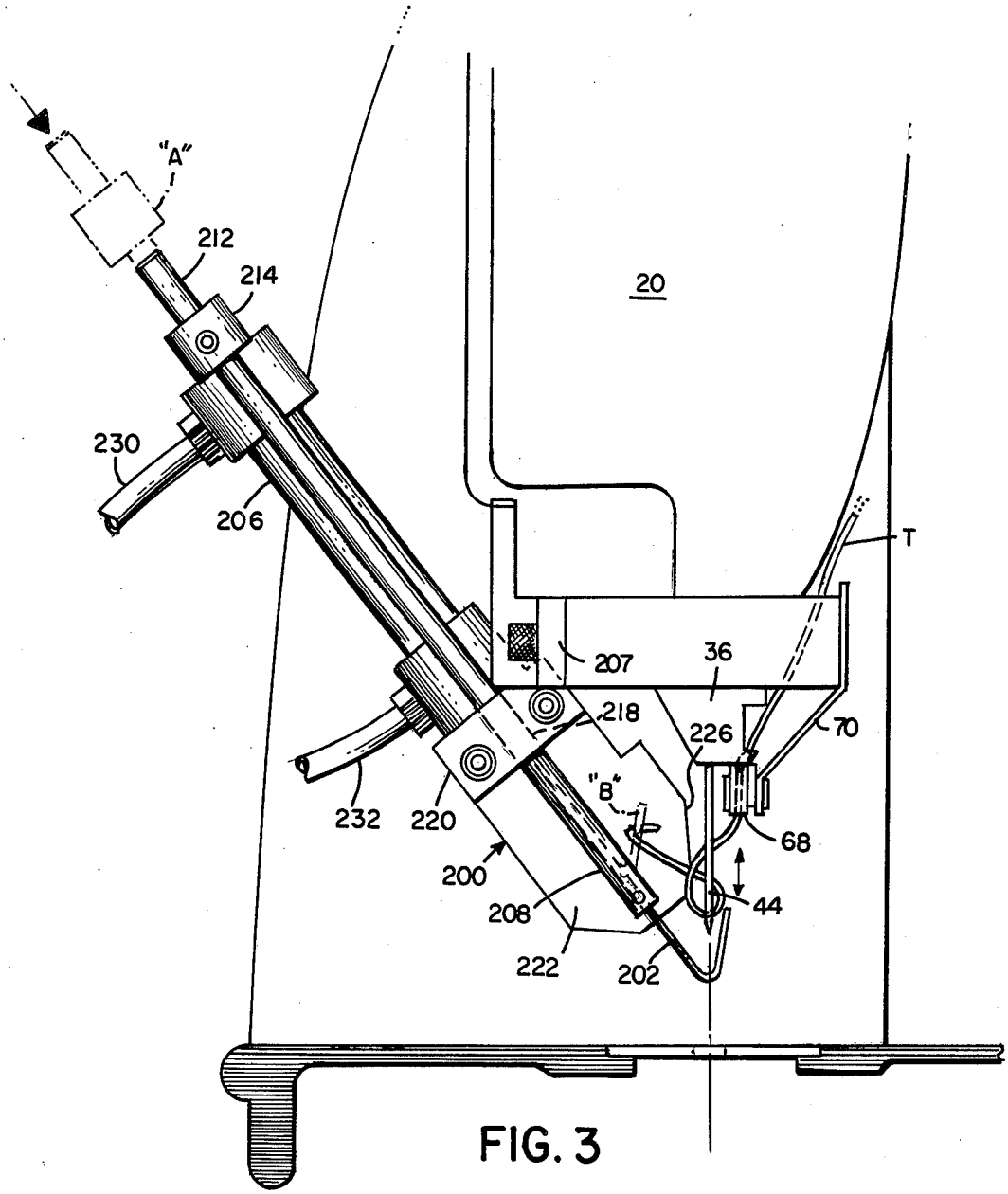
FIG. 3 is an elevational view of the sewing machine.
Figure 4:
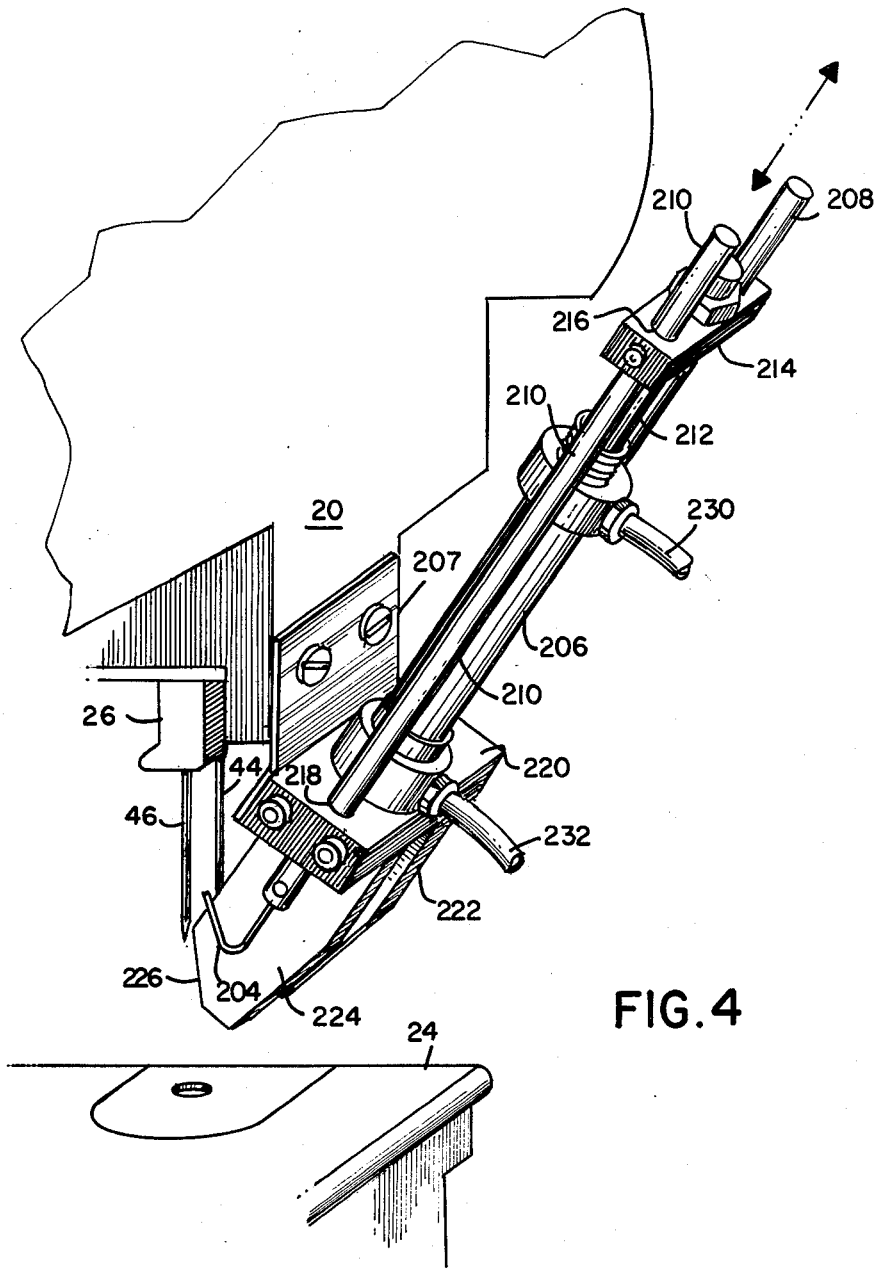
FIG. 4 is a partial perspective view of the thread wiping mechanism towards the head of the sewing machine from the driven end thereof.

A thread wiping mechanism 200, shown more clearly in FIGS. 2, 3 and 4 may be arranged on the backside of the machine 20, that is, the side opposite from the machine operator. The thread wiping mechanism 200 comprises a pair of articulated fingers 202 and 204 which each may be of hook shape, are shown respectively in FIGS. 2 and 4. A drive means may include a pressurizable double acting cylinder 206, secured to the housing 22, by a bracket 207, arranged adjacent the stitching mechanism 26. The drive means may also comprise a solenoid arrangement, in place of any pressurizable cylinder(s). The first articulated finger 202 is secured to the distal end of a first shaft 208 as shown in FIGS. 2 and 3, and the second articulated finger 204 is secured to the distal end of a second shaft 210, as shown in FIG. 4. The drive means also includes a piston, not shown, arranged within the cylinder 206, having a piston rod 212 extending upwardly and outwardly therefrom. A first transverse bracket 214 is secured to the distal end of the rod 212. The upper end of each shaft 208 and 210 is respectively secured in a bore 216 in the bracket 214. The other, lower end of each shaft 208 and 210 is slidably received in a bore 218 in a second transverse bracket 220 to which the lower end of the cylinder 206 is attached.

A pair of wiper plates 222 and 224 extend downwardly from the second bracket 220 immediately adjacent and generally parallel to each articulated finger 202 and 204. Each wiper plate 222 and 224, has a distal edge 226 which is generally parallel to the needles 44 and 46.

The pressurizable cylinder 206 is serviced by a first and a second pressurizable fluid supply conduit 230 and 232 which channels pressurizable fluid from a proper regulatable pressurizable source, not shown, to the cylinder 206.

In operation of the sewing machine 20, the thread wiping mechanism 200 is pressurized by effecting pressurized fluid to be channeled through conduit 230 to cause the piston rod 212 to move downwardly in the cylinder 206, from its position shown in phantom lines in FIG. 3 and designated "A" and "B" to the lower position shown in full line drawing therein, prior to the needles 44 and 46 shifting by actuation of the indexing mechanism 32, as recited in the aforementioned U.S. patent application Ser. No. 315,415. The fingers 202 and 204 extend to a position, shown in FIG. 3, wherein the lowest portion or trough of the fingers 202 and 204 are beneath the needles 44 and 46. The thread from whichever needle is the "to-be-active" needle 44 or 46, is then released from between its respective resilient wheel 68 or 74 and distal portion of its respective needle holder 48 or 50 because of the needles and needle holders are caused to shift with respect to the resilient wheels 68 and 74. The thread "T" from the remaining "to-be-inactive" needle 44 or 46 is secured as it passes between its respective resilient wheel 68 or 74 and its respective needle holder 48 or 50. The wiper fingers 202 and 204 are then retracted by pressurized fluid entering the cylinder 206 through the conduit 232, and the end of the thread which has been cut by known means, in the now inactive needle is pulled out of the workpiece due to its being caught by its respective returning finger 202 or 204. This return motion of the retracting finger does not pull the thread from the inactive needle because the respective resilient wheel 68 or 74 holds (pinches) the thread against its respective needle holder 48 or 50, and because each wiper finger 202 and 204 passes by their respective needle 44 and 46 on the side opposite from which the thread enters from above, to keep the inactive needle threaded.

The retracted wiped position of finger 202 being shown in FIG. 3, by the dashed lines indicated at "B", the thread "T" being shown wiped or pinched against its respective wiper plate 222, in this case.

The distal ends of the fingers 202 and 204 may be biased against their respective wiper plate 222 and 224, the finger 202 and 204 holding the end of the thread "T" of the now inactive needle 44 or 46 thereagainst.

It is to be noted, that the fingers 202 and 204, may have slightly different configurations, and that they may be actuated independently by independent means such as a pair of pressurizable cylinders or the like.

We claim:

1. A thread wiping mechanism for a sewing machine having a plurality of shuttleable needles thereon, which wiping mechanism is employed to retract the threads of any needle which is inactive in said machine comprising:

a needle holder assembly slidably arranged on a sewing machine head;

a thread wiper arranged to remove any thread from any inactive needle out of the sewing path of any active needle.

2. A thread wiping mechanism for a sewing machine, as recited in claim 1, wherein said thread wiper comprises a reciprocable mechanism arranged adjacent said needle holder assembly on said sewing machine head.

3. A thread wiping mechanism for a sewing machine, as recited in claim 2, wherein said reciprocable mechanism includes a curved wiper finger disposed on the distal end of a reciprocable shaft.

4. A thread wiping mechanism for a sewing machine, as recited in claim 3, wherein each shuttleable needle has a wiper finger associated therewith.

5. A thread wiping mechanism for a sewing machine, as recited in claim 3, wherein said reciprocable mechanism also includes a pressurizable cylinder secured to said wiper finger, said pressurizable cylinder being operable to effect the reciprocable motion of said wiper finger.

6. A thread wiping mechanism for a sewing machine, as recited in claim 3, wherein said wiper finger has a trough portion which when fully extended, is beneath its respective needle.

7. A thread wiping mechanism for a sewing machine, as recited in claim 3, wherein a plate is arranged parallel to each wiper finger in its retracted position.

8. A thread wiping mechanism for a sewing machine, as recited in claim 5, wherein all of said wiper fingers are actuated by a single pressurizable cylinder.

9. A thread wiping mechanism for a sewing machine, as recited in claim 7, wherein said wiper finger clinches the thread of an inactive needle between said plate and said wiper finger.

10. A method of removing thread of an inactive needle from the sewing path of an active needle in a shuttleable multiple needle sewing machine comprising:

providing an actuatable reciprocable thread wiping mechanism adjacent the shuttleable needle mechanism on the sewing machine;

actuating said thread wiping mechanism so as to extend a wiping finger beneath its needle;

shuttling said shuttleable multiple needle mechanism in a support wherein a needle is shifted from an active position to an inactive position and a needle is shifted from an inactive position to an active position.

11. A method of removing thread of an inactive needle, as recited in claim 10, including:

actuating said thread wiping mechanism so as to retract itself from beneath its respective needle;

catching the thread of said inactive needle on said finger on the distal end of said thread wiping mechanism.

12. A method of removing thread of an inactive needle, as recited in claim 11, including:

pulling the thread of said inactive needle from any material being stitched, with said finger in the distal end of said wiping mechanism.

13. A method of removing thread of an inactive needle, as recited in claim 12, including:

providing a generally flat plate adjacent each of said wiper fingers;

wiping said pulled thread against said flat member by said wiping finger.

14. A method of removing thread of an inactive needle, as recited in claim 13, including;

pinching said pulled thread of said inactive needle between said wiping finger and said flat member, until subsequent reactuation of said thread wiping mechanism effectuates subsequent extension thereof beneath its needle and release thereby of said wiped thread.

* * * * *